US008766119B2

(12) United States Patent
Cotha et al.

(10) Patent No.: US 8,766,119 B2
(45) Date of Patent: Jul. 1, 2014

(54) WATER SEALING BUTTONS FROM THE EXTERIOR

(75) Inventors: Ajit C. Cotha, Atlanta, GA (US); Thomas E. Gitzinger, Libertyville, IL (US)

(73) Assignee: Motorola Mobility LLC, Chicago, IL (US)

( * ) Notice: Subject to any disclaimer, the term of this patent is extended or adjusted under 35 U.S.C. 154(b) by 335 days.

(21) Appl. No.: 13/277,240

(22) Filed: Oct. 20, 2011

(65) Prior Publication Data

US 2013/0098740 A1 Apr. 25, 2013

(51) Int. Cl.
*H01H 13/06* (2006.01)

(52) U.S. Cl.
USPC ..... 200/302.2

(58) Field of Classification Search
USPC ..... 200/302.2; 277/438, 530, 567, 647
See application file for complete search history.

(56) References Cited

U.S. PATENT DOCUMENTS

| | | | | |
|---|---|---|---|---|
| 6,483,057 | B1 | 11/2002 | Wu | |
| 6,717,082 | B1 | 4/2004 | Wu | |
| 6,963,039 | B1 | 11/2005 | Weng et al. | |
| 7,145,091 | B1 | 12/2006 | Wang | |
| 7,371,985 | B2 | 5/2008 | Chen | |
| 7,420,136 | B2 * | 9/2008 | Goetzl et al. | 200/341 |
| 2007/0163868 | A1 | 7/2007 | Yamamoto et al. | |
| 2010/0072046 | A1 | 3/2010 | Maeda et al. | |
| 2011/0042192 | A1 | 2/2011 | Hou et al. | |

* cited by examiner

*Primary Examiner* — Renee Luebke
*Assistant Examiner* — Lheiren Mae Caroc

(57) ABSTRACT

An electronic device 28 with an effective water sealing button system 26 comprising a special compression gasket seal with compressive faces 30 and 32 and deformable annular seal portions 34 and 36 to dynamically seal a moveable side key 20 providing a button 22 against a housing 40 of the electronic device and accommodate non-binding sliding movement of the side key while controlling the spacing and tactile feel of the side key.

18 Claims, 4 Drawing Sheets

WATER SEALING BUTTONS FROM THE EXTERIOR

BACKGROUND OF THE INVENTION

1. Field of the Disclosure

The disclosure relates in general to mobile devices, and more particularly, to mobile electronic devices with an electronic display and a keypad. In certain embodiments, the mobile electronic device comprises a mobile telephone, but the disclosure is not limited to mobile telephones.

2. Background Art

Mobile phones and other electronic devices are very useful for: telephone calls; internet usage; e-mailing; texting; downloading; photography; video conferencing; surfing and searching the world wide web; retrieving, storing and viewing information; social networking; calculating; computing, playing games, etc. Most electronic devices will fail, short out, or otherwise become ineffective or less effective, upon exposure to too much moisture, such as heavy rain, sleet, snow, or from swimming or being submerged in water, such as accidentally dropping the phone in toilets, puddles, swimming pools, basins or sinks.

Over the years various attempts have been made to seal buttons, keys, and other features of electronic devices. These attempts have met with varying degrees of success. However, most conventional prior sealing designs and systems do not effectively seal and waterproof the side keys of an electronic device. There is a need to waterproof keys and switches of the mobile phones and other electronic devices to help prevent ingress (inflow) of water, as well as many other liquids from entering into the interior of the electronic device so that the electronic device can function and operate in its intended manner when exposed to moisture.

It is, therefore, desirable to provide an improved water sealing button system for side keys of an electronic device which overcomes most, if not all, of the preceding problems.

SUMMARY OF THE INVENTION

An improved water sealing button system effectively seals and waterproofs the side key buttons of an electronic device. The improved water sealing button system provides a unique sealing design for the electronic device which is cost-effective, attractive, and effective. The user friendly water sealing button system is reliable, easy to use, and comfortable. It can also provide better tactile feel and touch control. The improved water sealing button system solves the problem of water sealing a button in a mobile phone or other electronic device in an inexpensive manner.

The improved water sealing button system can be used with any electronic device that requires a higher level of water ingress protection. The electronic device can be a mobile electronic device, such as: a radiotelephone, a cellular (cell) phone, a mobile phone, smart phone, flip phone, slider phone, phone, tablet phone, camera phone, clamshell device, portable networking device, qwerty flip device, wireless device, portable gaming device, mobile communications device, personal digital assistant (PDA), wireless e-mail device, a two way pager, internet communication device, tablet device, laptop computer, netbook, personal computer, hand held electronic device, or combinations of any of the preceding.

The design feature creates a water seal by default compression of the gasket. When submerged, the water pressure will increase the seal by forcing the gasket surfaces against the button and housing surfaces. This is a good non-expensive option for phones and accessory products that require an effective inexpensive water seal design.

The compression gasket seal can provide a small silicone piece that will slide on to the shaft of the button. The silicone piece can be designed such that the surfaces of the silicone piece will create a water seal on both the button surface and the housing surface.

The improved water sealing button system provides a feasible and effective way to seal and protect keys on the mobile electronic device from water and many other liquids.

The electronic device with the improved water sealing button system can include: (1) a mobile housing with an external mounted movable key that moves within the housing; (2) an elastomeric compression gasket seal that is sandwiched between and contacts the moveable key and housing; (3) in which the cross-sectional profile of the elastomeric gasket seal has the dual function of a spring and seal; and (4) in which the elastomeric compression gasket seal matingly and abuttingly engage and seal smooth faces and surfaces of the housing and moveable key.

The electronic device with the improved water sealing button system can further comprise: a moveable side key, housing, and a compression gasket seal. The moveable side key can have a head providing a button, a plunger for engaging and activating a switch, and an intermediate portion extending between the button and plunger. The compression gasket seal can have compressive faces and deformable annular seal portions for dynamically sealing and engaging the side key and the housing to accommodate non-binding sliding movement of the side key while controlling the spacing and tactile feel of the side key.

The side key can be a front loaded side key. The intermediate portion can comprise a stem providing a shaft. The stem can have a maximum diametric span smaller than the head and the stem can have a maximum diametric span smaller than the plunger.

The compression gasket seal preferably comprises substantially symmetrical outer and inner annual seal sections. In the illustrated embodiment, the compression gasket seal has outer and inner rims and a hub which is positioned between and integrally connected to the outer and inner rims. Preferably, the hub has a maximum hub diameter that is smaller than the maximum rim diameter of each of the rims. In the illustrated embodiment, the compression gasket seal also has a generally X-shaped cross-sectional configuration. Desirably, the compression gasket seal has concave radially inwardly portions which provide cutouts for facilitating bending, flexing and compression of the seal.

In the preferred form, the water sealing button system of the electronic device comprises an elastomeric resilient compression gasket seal which provides a spring for sealing and accommodating non-binding sliding movement of the side key while controlling the spacing and tactile feel of the side key. The compression gasket seal being can be resiliently moveable from an expanded position when the side key is in a normal outward storage position to a contracted compressed position when the side key is pushed inwardly to a depressed inwardly engaging position. The elastomeric resilient compression gasket seal can comprise: an outer compressive face and outer deformable annular seal portion for hydrodynamically sealing and engaging an underside of a head of the side key; an inner compressive face and inner deformable annular seal portion for hydrodynamically sealing and engaging a sidewall of a frame of a housing of an electronic device; and annular central seal wall portions comprising a hub and defining a central shaft-receiving opening to slidably receive, hydrodynamically seal and engage a shaft of the side key.

In the illustrated embodiment, the compression gasket seal has a general X-shaped cross-sectional configuration with outer and inner annular flared portions. The outer annular flared portions can diverge outwardly and face the underside of the head and button of the side key and can have outer ends which are integrally connected to the outer annual seal portions. The inner annular flared portions can diverge inwardly and face the sidewall of the frame of the housing and can have inner ends which are integrally connected to the inner annual seal portions. In the illustrated embodiment, the compression gasket seal also has a central intermediate section with generally V-shaped intermediate flared portions with concave radially inwardly portions that provide cutouts for facilitating bending, flexing and compression of said seal.

The inventive electronic device with the water sealing button system and compression gasket seal as described in the patent claims hereafter have achieved unexpected surprisingly good results.

A more detailed explanation of the invention is provided in the following detailed descriptions and appended claims taken in conjunction with the accompanying drawings.

DETAILED DESCRIPTION OF THE INVENTION

The following is a detailed description and explanation of the preferred embodiments of the invention and best modes for practicing the invention.

Figure 1:
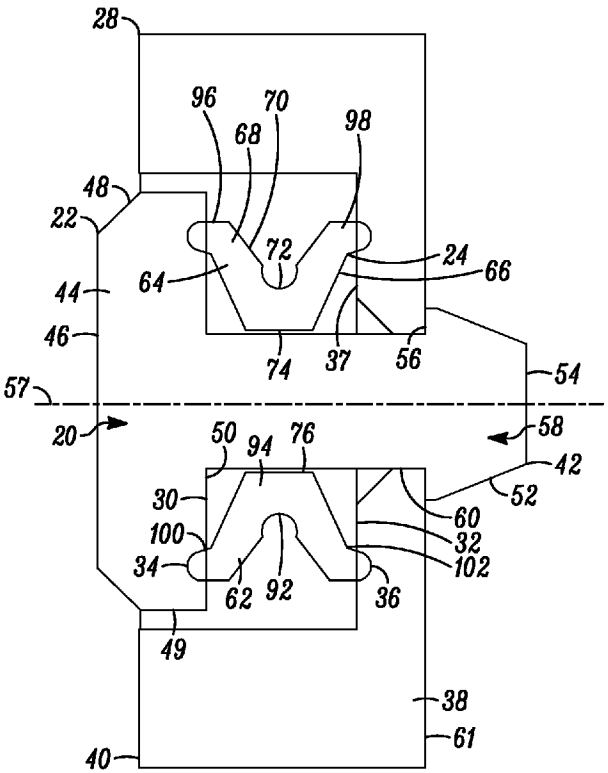
FIG. 1 is a cross-sectional view of a side key providing a button sealed by a compression gasket seal of a water sealing button system of an electronic device in accordance with principle of the present invention.

As shown in the FIG. 1 of the drawings, a front-loaded moveable side key 20 provides a button 22 is retained and water sealed by a compression (compressible) gasket seal 24 that provides an elastomeric resilient compression spring of a water sealing button system 26 of an electronic device 28. The compression gasket seal and water sealing button system provides compressive (compressible) faces 30 and 32 and perimeter (peripheral) deformable elastomeric circular annular seal portions 34 and 36 that can dynamically seal and engage the side key and can be positioned against the outwardly facing sidewall 37 of a rigid frame 38 of the housing 40. The seal can be made of silicone or another elastomeric material. The seal assembly can control the spacing and tactile feel of the side key.

The front loaded moveable side key 20 (FIG. 1) which can be front loaded from outside the housing of the electronic device and retained in the housing by the snap head feature of a frustoconical plunger 42 and an enlarged button head 44 can comprise a button with a finger tip-engageable surface 46 providing a head portion or cap facing outwardly from the electrical device. The enlarged button head can have a chamfer 48 providing beveling, an annular rim 49 which provides the maximum diameter and span of the enlarged button head, and an inwardly interior facing annular underside 50 providing a bottom face or chin. The frustoconical plunger can have a frustoconical section with outwardly diverging sides 52, an end providing a switch-engaging portion 54 that faces inwardly into the interior of the electronic device, and an outwardly facing annular portion 56. The front loaded side key can have an elongated stem 58 along a longitudinal axis 57. The stem provides an intermediate portion and a shaft that extends between and integrally connects the underside of the button head and the frustoconical plunger. The side key and seal can be concentrically positioned about the longitudinal axis. The stem (shaft) is moveable through an opening 60 providing a hole in the frame of the housing. The side key and button can be made of plastic or metal. The frame and housing can be made of plastic or metal. The stem (shaft) can have a maximum transverse, lateral or diametric span that is smaller than the maximum transverse, lateral or diametric span of the enlarged head, and is smaller than the maximum transverse, lateral or diametric span of the frustoconical plunger. The side key plunger can be closely aligned to a switch. The switch can be a flex mounted switch, dome switch, or printed circuit board (PCB) mounted switch.

Figure 5:
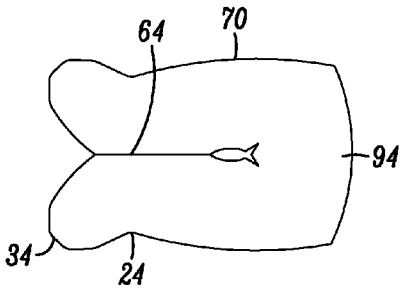
FIG. 5 is a cross-sectional view of the left part of the compression gasket seal of a water sealing button system similar to FIG. 3 and illustrating the left part of the compression gasket seal in a deformed compressed position with almost maximum compression.
Figure 6:
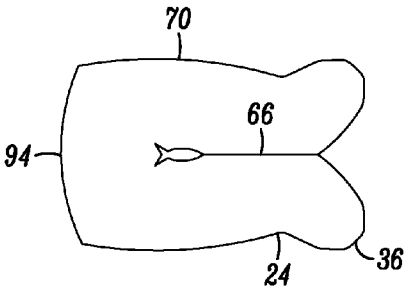
FIG. 6 is a cross-sectional view of the right part of the compression gasket seal of water sealing button system similar to FIG. 4 and illustrating the right part of the compression gasket seal in a deformed compressed position with almost maximum compression.

The side key is moveable from a normal outward storage position as shown in FIG. 1 in which the outwardly facing annular portion 56 of the plunger abuttingly engages the inwardly facing sidewall 61 of the frame to a depressed inwardly engaging position in which the plunger can engage, contact and active the switch. In the normal outward storage position, the compression gasket seal is in an expanded position in which the outer (outward) seal portion 34 of the compression gasket seal compressively, abuttingly and hydrodynamically engages and seals the underside 50 of the enlarged button head of the side key and the inner (inward) seal portion 36 of the compression gasket seal compressively, abuttingly and hydrodynamically engages and seals the sidewall 37 of the rigid frame 38 of the housing 40. When the button of the side key is pushed and depressed inwardly to the depressed inwardly engaging position, the compressions gasket seal is further compressed, squeezed and deformed to a contracted compressed deformed position, such as shown in FIGS. 5 and 6, and the end of the plunger providing the switch-engaging portion will engage, contact and activate the switch. In the depressed inwardly engaging position, the outer (outward) seal portion of the compression gasket seal compressively and hydrodynamically engages and seals the underside of the enlarged button head of the side key and the inner (inward) seal portion of the compression gasket seal compressively and hydrodynamically engages and seals the sidewall of the rigid frame of the housing.

The compression gasket seal can have a general X-shaped cross-section 62 (FIG. 1) providing a general X-shaped cross-sectional configuration with outer concave annular flared portions 64 which can diverge outwardly and face the underside 50 of the enlarged head 44 and button of the side key and inner concave annular flared portions 66 which can diverge inwardly and face the sidewall 37 of the frame 38 of the housing 40. The outer ends of the outer flared annular portions 64 of the seal can be integrally connected to the outer annual seal portions 34 of the seal. The inner ends of the inner flared annular portions 66 of the seal can be integrally connected to the inner annual seal portions 36 of the seal. The central intermediate section 68 of the seal can comprise generally V-shaped intermediate flared portions 70 with concave radially inwardly accurate portions 72 which can provide cutouts or cutout sections, such as semicircular cutouts that facilitate bending, flexing and compression of the seal. The V-shaped portions of the seal can be at an acute angle of inclination in the expanded position, preferably 60 degrees to 70 degrees. The outer flared portions 64 of the seal can be at an obtuse angle of inclination in the expanded position, preferable 120 degrees to 150 degrees. In the illustrated embodiment, the cross-section of the arcuate portions of the seal providing cutouts can each range from 180 degrees to 240 degrees in the expanded position.

The seal can also has have inner annular central seal wall portions 74 (FIG. 1) which can provide a hub with a central shaft-receiving opening 76 that peripherally and circumferentially surrounds and dynamically receives the slidable stem (shaft) 58 of the moveable side key. The annular seal wall portions of the seal can hydrodynamically seal and slidably engage the stem when the side key is in and moving between the normal outward storage position and the depressed inwardly engaging position.

When the button is not depressed, the compression gasket seal urges and resiliently biases the button to the normal outward storage position as shown in FIG. 1. When the button of the side key is pushed or pressed inwardly to the depressed inwardly engaging position, the compression gasket seal is further compressed, squeezed and deformed to a contracted compressed position in which the V-shaped portions 70 are pressed and contact and touch each other with a zero degree angle of inclination at their outer sections, as shown in FIGS. 5 and 6.

The expanded compression gasket seal can have a nominal compression, such as to 0.3 mm. The compression gasket seal can compress against the metal button and the sidewall of the frame of the plastic housing at the same time to simultaneously and concurrently seal both surfaces. The illustrated design and construction of the expanded gasket seal permits travel for button actuations, which can be approximately 0.5 mm. The illustrated design and construction can be tweaked or modified for less or more travel of the button. The cut outs in the compression gasket seal help aid in bending back while maintaining the seal.

Figure 2:
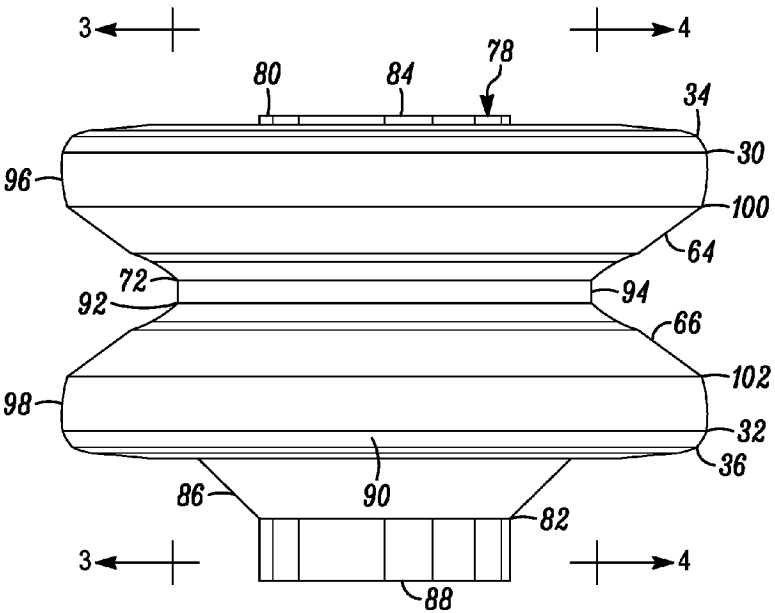
FIG. 2 is an enlarged perspective view of the compression gasket seal of a water sealing button system sealing and illustrating part of another side key providing a button in accordance with principle of the present invention.

FIG. 2 is an enlarged perspective view of the compression gasket seal of water sealing button system sealing and illustrating part of another front loaded moveable side key 78 providing a button 80. The side key can be front loaded from outside the electronic device and retained in the housing by the snap head feature of a frustoconical plunger 82 and a button head 84 which can comprise a finger tip-engageable button surface providing a head portion or cap which faces outwardly from the electrical device. The plunger can have a frustoconical section 86 with outwardly diverging sides and an end providing an inwardly facing switch-engaging portion 88 that faces inwardly into the interior of the electronic device. The front loaded side key can have an elongated stem 90 along a longitudinal axis. The stem provides an intermediate portion and a shaft that can extend between and integrally connect the button head and the frustoconical section of the plunger.

As shown in FIG. 2, the compression gasket seal can have an annular central intermediate portion 92 which can provide a hub 94 and can have annular outer and inner rims 96 and 98. The hub preferably has a smaller maximum hub diameter that each of the outer and inward rims and other portions of the compression gasket seal. The hub can be positioned and sandwiched between and integrally connected to symmetrical outer and inner annular seal sections (portions) 100 and 102. The rigid surfaces defining the side key and the plastic housing, as well as the cutout 72 in the compression gasket seal help aid in bending back, while maintaining the seal. The initial gap between the seal and the rigid surfaces of the side key can be 0.31 mm. The total displacement can be 0.81 mm to account for the worst case compression, such as 0.5 mm.

Figure 3:
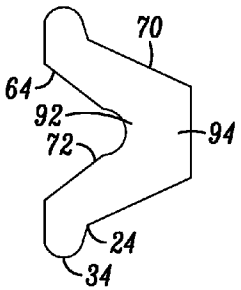
FIG. 3 is a cross-sectional view of the left part of the compression gasket seal of a water sealing button system taken substantially along line 3-3 of FIG. 2 and illustrating the left part of the compression gasket seal of FIG. 2 in an expanded position with minimal compression.
Figure 4:
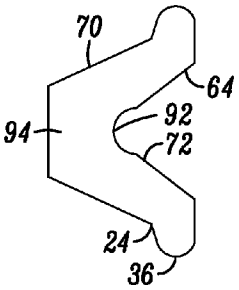
FIG. 4 is a cross-sectional view of the right part of the compression gasket seal of a water sealing button system taken substantially along line 4-4 of FIG. 2 and illustrating the right part of the compression gasket seal of FIG. 2 in an expanded position with minimal compression.

FIG. 3 is a cross-sectional view of the left part of the compression gasket seal of a water sealing button system taken substantially along line 3-3 of FIG. 2 and illustrating the left part of the compression gasket seal of FIG. 2 in an expanded position with minimal compression. FIG. 4 is a cross-sectional view of the right part of the compression gasket seal of a water sealing button system taken substantially along line 4-4 of FIG. 2 and illustrating the right part of the compression gasket seal of FIG. 2 in an expanded position with minimal compression. FIGS. 3 and 4 illustrate the undeformed geometry of the illustrated parts of the compression gasket seal. Contact occurs between the rubber seal and the side key.

FIG. 5 is a cross-sectional view of the of the left part of the compression gasket seal of a water sealing button system similar to FIG. 3 and illustrating the left part of the compression gasket seal in a deformed compressed position with almost maximum compression. FIG. 6 is a cross-sectional view of the right part of the compression gasket seal of a water sealing button system similar to FIG. 4 and illustrating the right part of the compression gasket seal in a deformed compressed position with almost maximum compression. FIGS. 5 and 6 illustrate the deformed geometry of the illustrated parts of the compressions gasket seal at almost maximum compressions, such as at 0.81 mm displacement. Since the self contact of the seal was not modeled, the reaction force can be marginally higher.

Figure 7:
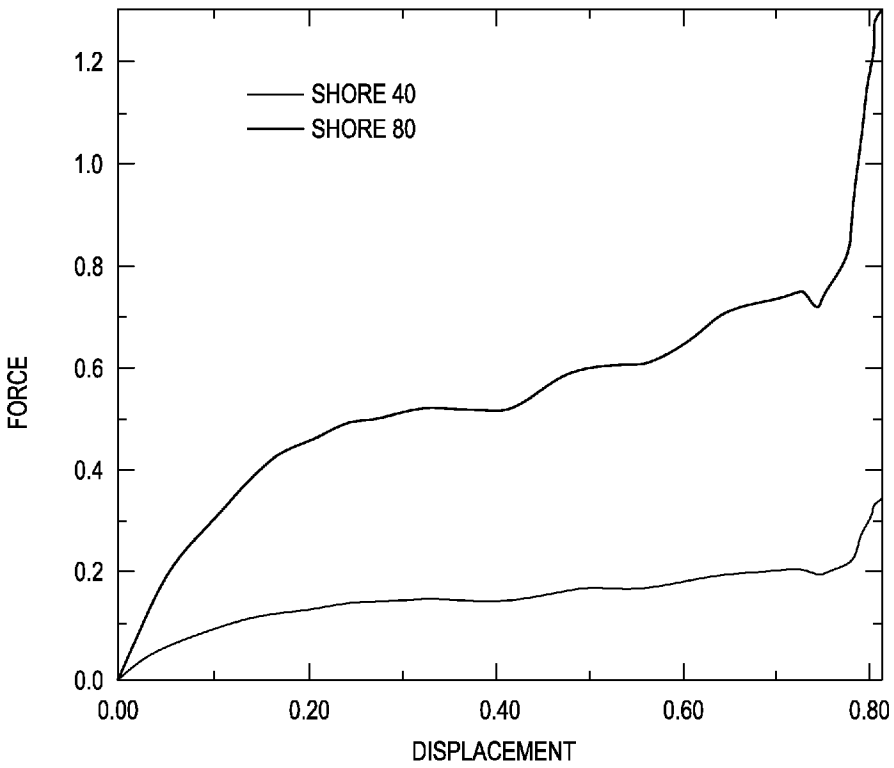
FIG. 7 is a graph of the compression gasket seal of the water sealing button system and illustrating the displacement of the compression gasket seal as a function of the compression force on the side key.

FIG. 7 is a graph of the compression gasket seal of the water sealing button system and illustrating the displacement of the compression gasket seal in mm as a function of the compression force in newtons (N) on the side key. The upper line on the graph illustrates a compression gasket seal with Shore 80 Durometer hardness with a force of up to 1.3 N and a displacement of 0.80 millimeters (mm). The lower line on the graph illustrates a compression gasket seal with Shore 40 Durometer hardness with a force of up to 0.35 N and a displacement of 0.80 mm.

The mobile electronic device can be a radiotelephone, a cellular (cell) phone, a mobile phone, smart phone, flip phone, slider phone, tablet phone, camera phone, clam shell device, portable networking device, qwerty flip device, wireless device, portable gaming device, mobile communications device, personal digital assistant (PDA), wireless e-mail device, a two way pager, internet communication device, tablet device, laptop computer, netbook, personal computer, hand held electronic device, or combinations of any of the preceding. Desirably, the mobile electronic device is of a compact size for readily fitting in a shirt pocket, pants pocket, suit pocket, and/or purse.

As described above, the preferred electronic device comprises a mobile electronic device having a housing, front loaded moveable side key and water sealing button system. The housing can have a substantially rigid frame with an outwardly facing sidewall and an inwardly facing sidewall and can have an opening providing a hole. The front loaded moveable side key can be loaded from outside the electronic device. The side key can provide a button with: (a) an enlarged head comprising a finger tip-engaging cap which faces outwardly from the electrical device and an underside which faces inwardly into the interior of the electrical device; (b) a plunger comprising a frustoconical section with diverging sides and an inwardly facing switch-engaging portion for engaging and activating a switch and an outwardly facing annular portion; and (c) an intermediate portion comprising a stem which can provide a shaft that integrally extends between and connects to said head and plunger. Preferably, the frustoconical plunger and the enlarged head cooperate with each other to provide a snap head feature for retaining the front loaded side key in the housing. The stem can have a maximum transverse stem span that is smaller than a maximum diametric head span of the enlarged head and a maximum transverse stem span which is smaller than a maximum transverse plunger span of the frustoconical plunger. The shaft can be moveable and slidable in the hole in the frame. In operation, the side key is moveable from a normal outward storage position in which the outwardly facing annular portion of the plunger abuttingly engages the inwardly facing sidewall of the frame of the housing to a depressed inwardly engaging position in which the plunger engages, contact and activate the switch.

Preferably, the water sealing button system of the electronic device comprises an elastomeric resilient compression gasket seal which provides an elastomeric spring for resiliently sealing and accommodating non-binding sliding movement of the side key while controlling the spacing and tactile feel of the side key. The compression gasket seal can be resiliently moveable from an expanded position when the side key is in a normal outward storage position to a contracted compressed position when the side key is pushed inwardly to a depressed inwardly engaging position. The elastomeric resilient compression gasket seal can comprise: an outer compressive face and outer deformable annular seal portion for hydrodynamically sealing and engaging an underside of a head of the side key; an inner compressive face and inner deformable annular seal portion for hydrodynamically sealing and engaging a sidewall of a frame of a housing of the electronic device; and annular central seal wall portions comprising a hub and defining a central shaft-receiving opening to slidably receive, hydrodynamically seal and engage a shaft (stem) of the side key.

In the preferred embodiment, the compression gasket seal has a general X-shaped cross-sectional configuration with outer and inner annular flared portions. The outer annular flared portions can diverge outwardly and face the underside of the head and button of the side key and can have outer ends which are integrally connected to the outer annual seal portions. The inner annular flared portions can diverge inwardly and face the sidewall of the frame of the housing and can have inner ends which are integrally connected to the inner annual seal portions. In the illustrated embodiment, the compression gasket seal also has a central intermediate section with generally V-shaped intermediate flared portions having concaved radially inwardly portions providing cutouts for facilitating bending, flexing and compression of said seal.

Preferably, the mobile electronic device comprises a phone, such as a: radiotelephone, cellular (cell) phone, mobile phone, smart phone, flip phone, slider phone, tablet phone, camera phone, clam shell phone, portable networking phone, qwerty flip phone, wireless phone, e-mail phone, internet phone, computer phone, electronic phone device or combinations of any of the preceding.

Among the many advantages of the water sealing button system for an electronic device are:

1. Superior capability.
2. Superb performance.
3. Enhanced operation.
4. Excellent sealing and waterproofing of sides keys.
5. Outstanding ability to function with exterior moisture.
6. Better tactile feeling and touch control.
7. Comfortable.
8. Reliable.
9. User friendly.
10. Easy to operate.
11. Durable.
12. Economical.
13. Attractive.
14. Efficient.
15. Effective.

Although embodiments of the invention have been shown and described, it is to be understood that various modifications, substitutions, and rearrangements of parts, components, and/or process (method) steps, as well as other uses of the water sealing button system and the electronic devices can be made by those skilled in the art without departing from the novel spirit and scope of this invention.

What is claimed is:

1. A water sealing button system of an electronic device, comprising:

an electronic device comprising a moveable side key, a housing and a water sealing button system;

said moveable side key having a head providing a button, a plunger for engaging and activating a switch, and an intermediate portion extending between the button and plunger; and said water sealing button system comprising a compression gasket seal having compressive faces and deformable annular seal portions for dynamically sealing and engaging said side key and said housing to accommodate non-binding sliding movement of said side key while controlling the spacing and tactile feel of said side key, wherein the seal further comprises:

outer and inner rims;

a hub positioned between and integrally connected to said outer and inner rims; and said hub having a maximum hub diameter smaller than the maximum rim diameter of each of said rims.

2. A water sealing button system of an electronic device in accordance with claim 1 wherein said electronic device comprises a mobile electronic device selected from the group consisting of: a radiotelephone, a cellular (cell) phone, a mobile phone, smart phone, flip phone, slider phone, android phone, tablet phone, camera phone, clamshell device, portable networking device, qwerty flip device, wireless device, portable gaming device, mobile communications device, personal digital assistant (PDA), wireless e-mail device, a two way pager, internet communication device, android tablet, tablet device, laptop computer, netbook, personal computer, hand held electronic device, and combinations of any of the preceding.

3. A water sealing button system of an electronic device in accordance with claim 1 wherein:

said side key is a front loaded side key;

said intermediate portion comprises a stem providing a shaft;

said stem has a maximum diametric span smaller than said head; and said stem has a maximum diametric span smaller than said plunger.

4. A water sealing button system of an electronic device in accordance with claim 1 wherein said seal comprises substantially symmetrical outer and inner annual seal sections.

5. A water sealing button system of an electronic device in accordance with claim 1 wherein said seal has a generally X-shaped cross-sectional configuration.

6. A water sealing button system of an electronic device in accordance with claim 1 wherein said seal has concave radially inwardly portions providing cutouts for facilitating bending, flexing and compression of said seal.

7. A water sealing button system of an electronic device, comprising:

an elastomeric resilient compression gasket seal providing a spring for sealing and accommodating non-binding sliding movement of a side key while controlling spacing and tactile feel of the side key, said compression gasket seal being resiliently moveable from an expanded position when the side key is in a normal outward storage position to a contracted compressed position when the side key is pushed inwardly to a depressed inwardly engaging position;

said elastomeric resilient compression gasket seal comprising an outer compressive face and outer deformable annular seal portion for hydrodynamically sealing and engaging an underside of a head of the side key;

an inner compressive face and inner deformable annular seal portion for hydrodynamically sealing and engaging a sidewall of a frame of a housing of an electronic device; and annular central seal wall portions comprising a hub and defining a central shaft-receiving opening to slidably receive, hydrodynamically seal and engage a shaft of the side key.

8. A water sealing button system of an electronic device in accordance with claim 7 wherein the electronic device comprises a mobile electronic device selected from the group consisting of: a radiotelephone, a cellular (cell) phone, a mobile phone, smart phone, flip phone, slider phone, android phone, tablet phone, camera phone, clamshell device, portable networking device, qwerty flip device, wireless device, mobile communications device, personal digital assistant (PDA), wireless e-mail device, a two way pager, internet communication device, android tablet, tablet device, hand held electronic device, and combinations of any of the preceding.

9. A water sealing button system of an electronic device in accordance with claim 7 wherein said seal comprises substantially symmetrical outer and inner annual seal sections.

10. A water sealing button system of an electronic device in accordance with claim 7 wherein said seal comprises:

outer and inner rims having similar maximum rim diameters;

said hub is positioned between and integrally connected to said outer and inner rims; and said hub having a maximum hub diameter smaller than the maximum rim diameter of each of said rims.

11. A water sealing button system of an electronic device in accordance with claim 7 wherein said seal comprises:

a general X-shaped cross-sectional configuration with outer annular flared portions diverging outwardly and facing the underside of the head and button of the side key, said outer annular flared portion having outer ends integrally connected to said outer annual seal portions; and inner annular flared portions diverging inwardly and facing said sidewall of said frame of said housing, said inner annular flared portions having inner ends integrally connected to the inner annual seal portions.

12. A water sealing button system of an electronic device in accordance with claim 7 wherein said seal comprises:

a central intermediate section with generally V-shaped intermediate flared portions having concave radially inwardly portions defining cutouts for facilitating bending, flexing and compression of said seal.

13. A water sealing button system of an electronic device, comprising:

a mobile electronic device having a housing, a front loaded moveable side key and a water sealing button system;

said housing having a substantially rigid frame with an outwardly facing sidewall and an inwardly facing sidewall and defining an opening providing a hole;

said front loaded moveable side key being loaded from outside said housing and said electronic device, said side key providing a button with an enlarged head comprising a finger tip-engaging surface facing outwardly from said electrical device and an underside facing inwardly, a plunger comprising a frustoconical section with diverging sides and an inwardly facing switch-engaging portion for engaging and activating a switch and an outwardly facing annular portion, and an intermediate portion comprising a stem providing a shaft integrally extending between and connected to said head and plunger, said frustoconical plunger and said enlarged head cooperating with each other to provide a snap head feature for retaining said front loaded side key in said housing, said stem having a maximum transverse stem span smaller than a maximum diametric head span of said enlarged head, said maximum transverse stem span of said stem being smaller than a maximum transverse plunger span of said frustoconical plunger, said shaft being moveable and slidable in the hole in said frame, and said side key being moveable from a normal outward storage position in which said outwardly facing annular portion of said plunger abuttingly engages said inwardly facing sidewall of said frame to a depressed inwardly engaging position in which said plunger engages, contacts and activate the switch; and said water sealing button system comprising an elastomeric resilient compression gasket seal providing an elastomeric spring for sealing and accommodating non-binding sliding movement of said front loaded side key while controlling spacing and tactile feel of said front loaded side key, said compression gasket seal being resiliently moveable from an expanded position when said side key is in said normal outward storage position to a contracted compressed position when said head of said side key is pushed inwardly to said depressed inwardly engaging position, said seal having an outer compressive face and outer deformable annular seal portion for hydrodynamically sealing and engaging said underside of said enlarged head of said side key, an inner compressive face and inner deformable annular seal portion for hydrodynamically sealing and engaging said sidewall of said frame of the housing, and annular central seal wall portions comprising a hub and defining a central shaft-receiving opening to slidably receive, hydrodynamically seal and engage said shaft.

14. A water sealing button system of an electronic device in accordance with claim 13 wherein said mobile electronic device comprises a phone selected from the group consisting of: a radiotelephone, a cellular (cell) phone, a mobile phone, smart phone, flip phone, slider phone, android phone, tablet phone, camera phone, clamshell device, portable networking phone, qwerty flip phone, wireless phone, wireless e-mail phone, computer phone, internet phone, electronic phone device, and combinations of any of the preceding.

15. A water sealing button system of an electronic device in accordance with claim 13 wherein said seal comprises substantially symmetrical outer and inner annual seal sections.

16. A water sealing button system of an electronic device in accordance with claim 13 wherein said seal comprises:

outer and inner rims having a similar maximum rim diameter;

said hub is positioned between and integrally connected to said outer and inner rims; and said hub having a maximum hub diameter smaller than the maximum rim diameter of each of said rims.

17. A water sealing button system of an electronic device in accordance with claim 13 wherein said seal comprises:

a general X-shaped cross-sectional configuration with outer annular flared portions diverging outwardly and facing the underside of said enlarged head and button of said side key, said outer annular flared portion having outer ends integrally connected to said outer annual seal portions; and inner annular flared portions diverging inwardly and facing said sidewall of said frame of said housing, and said inner annular flared portions having inner ends integrally connected to the inner annual seal portions.

18. A water sealing button system of an electronic device in accordance with claim 13 wherein said seal comprises:

a central intermediate section with generally V-shaped intermediate flared portions having concave radially inwardly portions defining concave portions providing cutouts for facilitating bending, flexing and compression of said seal.

* * * * *